US005670947A

United States Patent [19]

Nagashima

[11] Patent Number: 5,670,947

[45] Date of Patent: Sep. 23, 1997

[54] LIGHT SCATTERING SMOKE SENSOR

[75] Inventor: Tetsuya Nagashima, Tokyo, Japan

[73] Assignee: Hochiki Corporation, Tokyo, Japan

[21] Appl. No.: 570,520

[22] Filed: Dec. 11, 1995

[30] Foreign Application Priority Data

Dec. 12, 1994 [JP] Japan ..... 6-307333

[51] Int. Cl.[6] ..... G08B 17/10

[52] U.S. Cl. ..... 340/628; 340/630; 361/756; 361/758; 250/564; 250/574

[58] Field of Search ..... 340/628, 630; 361/756, 758; 250/564, 574

[56] References Cited

U.S. PATENT DOCUMENTS

| | | | |
|---|---|---|---|
| 4,851,819 | 7/1989 | Kawai et al. | 340/630 |
| 5,021,677 | 6/1991 | Igarashi et al. | 250/574 |
| 5,302,837 | 4/1994 | Sawa et al. | 250/574 |
| 5,381,130 | 1/1995 | Thuillard et al. | 340/628 |
| 5,400,014 | 3/1995 | Behlke et al. | 340/628 |
| 5,430,307 | 7/1995 | Nagashima | 250/574 |
| 5,451,931 | 9/1995 | Muller et al. | 340/628 |
| 5,486,816 | 1/1996 | Ariga et al. | 250/574 |

FOREIGN PATENT DOCUMENTS

| | | | |
|---|---|---|---|
| 5157690 | 6/1993 | Japan | G01N 21/53 |

*Primary Examiner*—Jeffery Hofsass
*Assistant Examiner*—Timothy Edwards, Jr.
*Attorney, Agent, or Firm*—Sughrue, Mion, Zinn, Macpeak and Seas

[57] ABSTRACT

In a light scattering smoke sensor of the present invention, a first diaphragm portion is disposed just aheat of a light receiving device, and a second diaphragm portion is disposed ahead of the first diaphragm portion. A gap between the first and second diaphragm portion is a smoke introducing portion which introduces smoke to a smoke detecting space via a gap between labyrinth members and the second diaphragm portion.

8 Claims, 4 Drawing Sheets

LIGHT SCATTERING SMOKE SENSOR

BACKGROUND OF THE INVENTION

1. Field of the Invention

The invention relates to a light scattering smoke sensor including a light emitting device and a light receiving device for detecting smoke, and also a light receiving device covering member for covering the light receiving device.

2. Description of the Related Art

A conventional light scattering smoke sensor is described in, for example, Unexamined Japanese patent publication (Kokai) Hei. 5-157690.

In the light scattering smoke sensor, infrared rays are emitted into a compressed and flat smoke detecting chamber. When smoke flows into the smoke detecting chamber, light of the infrared rays scattered by the smoke is detected by a light receiving device. The light scattering smoke sensor includes an optical member for magnifying the visual field of the light receiving device to a flat visual field corresponding to the cross section shape of the chamber.

The optical member includes a light-converging member disposed in front of the light receiving face of the light receiving device, and further includes a field stop member disposed in front of the light-converging member.

The field stop member consists of a resin-molded product having a diaphragm opening of a rectangular slit shape. A groove is formed on an inner peripheral face of the opening so as to elongate in the circumferential direction.

Even when a photodiode having a relatively narrow visual field for detection is used as the light receiving device, therefore light scattered by smoke in the smoke detecting chamber can be detected in a wide visual field. In addition, since the visual field of the light receiving device is cut into a flat shape, it is possible to reduce the influence exerted by dirt on upper and lower end faces of the smoke detecting chamber.

In such a conventional light scattering smoke sensor, however, the resin-molded product having the diaphragm opening of a rectangular slit shape is formed by a single plate member in a holder which accommodates the light receiving device. That is, smoke flowing between labyrinth members may enter the smoke detecting area without passing through the diaphragm opening. For this reason, in the case where the labyrinth members are formed so as to have a large size, smoke will not flow smoothly into the smoke detecting area. This produces a problem in that the smoke detection is delayed.

The resin-molded product is formed by a single plate member. Therefore, the assembling of the body into a housing by means of screws, or the installation environment of the sensor may cause the plate member to be distorted. As a result, also the shape of the opening of the rectangular slit is distorted. Especially in a light scattering smoke sensor in which a rectangular slit is formed in the immediate vicinity of the light receiving device, any slight distortion may affect the light-receiving visual field. This produces another problem in that characteristics are varied among sensors.

SUMMARY OF THE INVENTION

It is an object of the present invention to provide a light scattering smoke sensor in which smoke can smoothly flow into a smoke detecting area to prevent the smoke detection from being delayed.

A light scattering smoke sensor of the present invention is comprised of: an opening for introducing smoke into the smoke sensor; a plurality of labyrinth members; a smoke detecting space which is surrounded by the plurality of labyrinth members; a light emitting device which emits light to the smoke detecting space; a light receiving device which receives light scattered by smoke introduced into the smoke detecting space; a first diaphragm portion, which is disposed just ahead of the light receiving device; a second diaphragm portion, which is disposed ahead of the first diaphragm portion; a cover member for covering the receiving device, in which the first diaphragm portion is provided; and a smoke introducing portion, which is disposed between the first and second diaphragm portions, for introducing smoke which enters through a gap between the labyrinth members.

In the light scattering smoke sensor of the invention, smoke entering between the labyrinth members is introduced into the smoke introducing portion, and then enters the smoke detecting space after passing through the second diaphragm portion. Even when the labyrinth members are formed so as to have a large size, therefore, the smoke detection can be prevented from being delayed, so that the smoke detection can rapidly be performed. As a result, the delay of the fire alarm can be prevented in advance from occurring.

Since the first diaphragm portion and the second diaphragm portion are disposed, the visual field of the light receiving device in the upward, downward, rightward, and leftward directions can be restricted. Accordingly, reflected light from the ceiling face, the floor face, and the right and left peripheral walls of the smoke detecting space can be prevented from entering the light receiving device. As a result, the S/N ratio can be improved, and it is possible to reduce the influence due to disturbance such as dust, condensation, and the like.

PREFERRED EMBODIMENTS OF THE INVENTION

Preferred embodiments of the present invention will be described with reference to the accompanying drawings.

Figure 1:
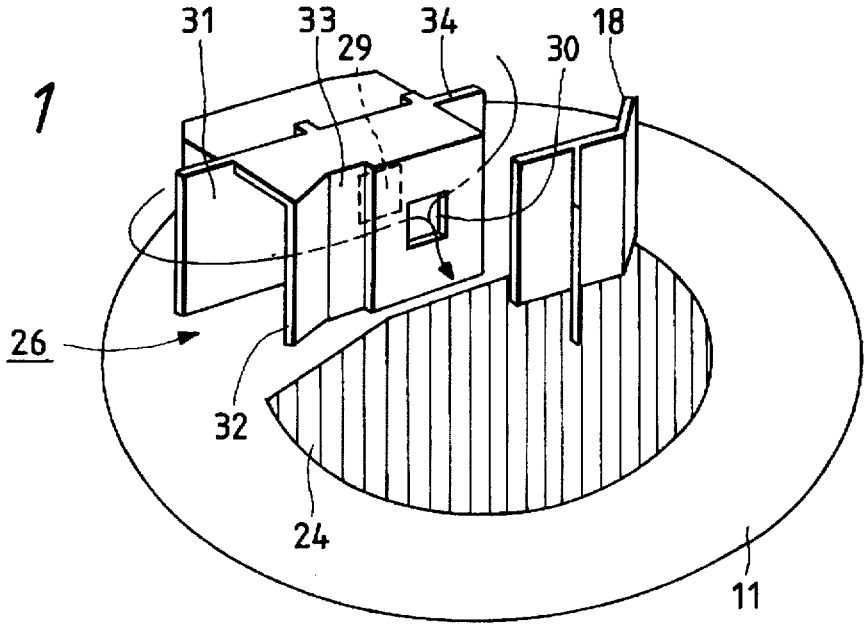
FIG. 1 is a view showing a light receiving portion cover of the present invention.
Figure 2:
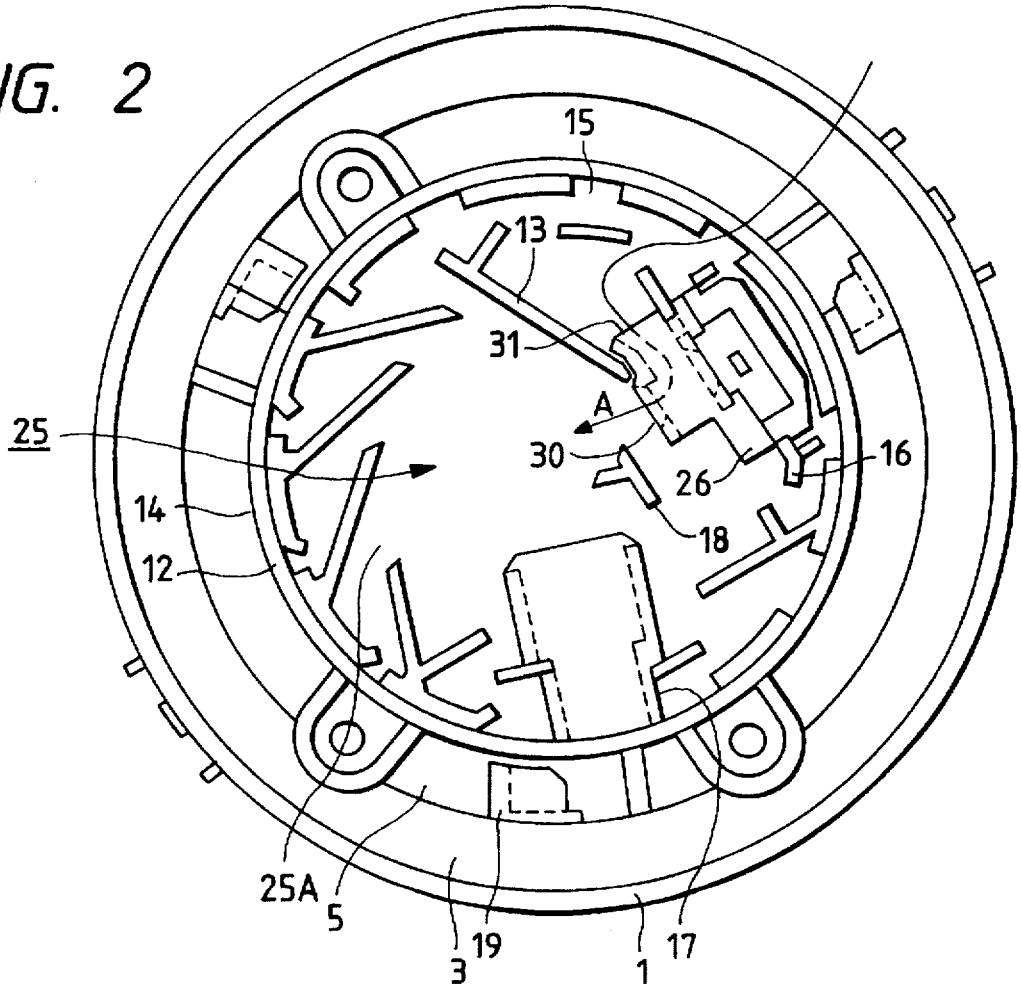
FIG. 2 is a transverse cross section view of a light scattering smoke sensor of the present invention.
Figure 3:
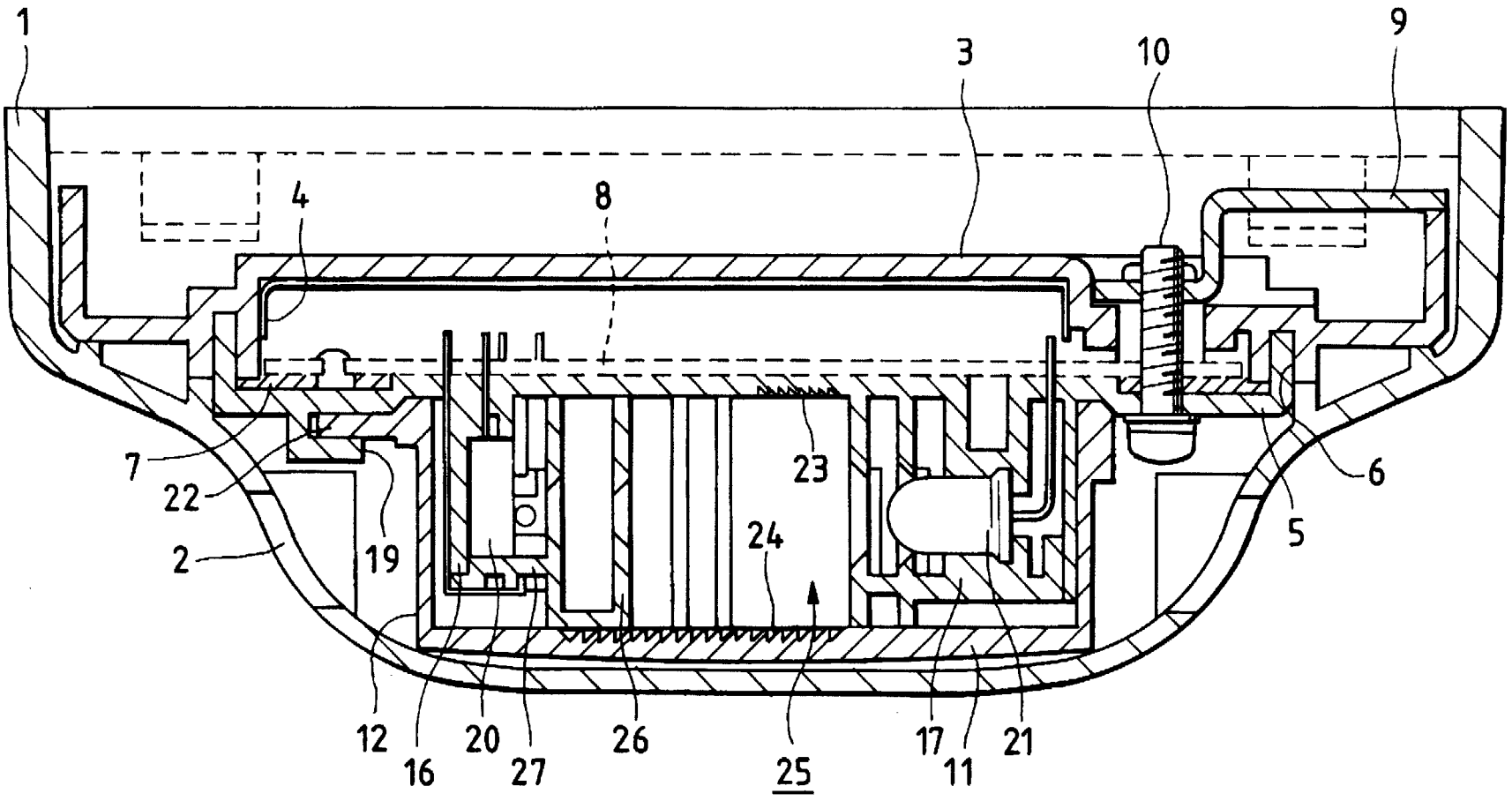
FIG. 3 is a longitudinal cross section view of the light scattering smoke sensor.

FIGS. 1 to 5 are views showing an embodiment of the present invention. FIG. 2 is a transverse cross section view of a light scattering smoke sensor of the present invention, and FIG. 3 is a longitudinal cross section view of the light scattering smoke sensor of the present invention.

In FIGS. 2 and 3, An outer cover 1 has an opening 2. The outer cover 1 accommodates a terminal board 3 therein. A shield case 4 is fixed to the inside of the terminal board 3. The reference numeral 5 designates a body of a smoke detecting unit. The smoke detecting unit body 5 is fitted into a fitting groove 6 of the terminal board 3. A printed circuit board 8 is attached onto the smoke detecting unit body 5 via a packing 7. The smoke detecting unit body 5, the packing 7, the printed circuit board 8, the terminal board 3, and fitting metal pieces 9 are fixed by means of screws 10. A smoke detecting unit cover 11 is detachably attached to the lower face of the smoke detecting unit body 5.

A plurality of labyrinth members 13 are formed inside a peripheral wall 12 of the smoke detecting unit cover 11. The labyrinth members 13 are formed so that smoke easily flows from the outside, and that light from the outside is cut off. An insect net 14 is integrally provided on the outside of the peripheral wall 12 of the smoke detecting unit cover 11 so that insects are prevented from invading the sensor and scattering light. In addition, a plurality of smoke inlets 15 are formed in the peripheral wall 12 of the smoke detecting unit cover 11.

Holders 16 and 17, a light shielding member 18, and an attachment portion 19 are integrally formed on the lower face of the smoke detecting unit body 5. The holder 16 accommodates a light receiving device 20 and a test infrared LED. The holder 17 accommodates a smoke-detecting infrared LED 21. The light shielding member 18 cuts off the infrared rays emitted from the smoke-detecting infrared LED 21 so that the infrared rays are not directly incident on the light receiving device 20. A projection 22 formed on the smoke detecting unit cover 11 is inserted into the attachment portion 19 so that the smoke detecting unit cover 11 is detachably attached to the smoke detecting unit body 5.

Antireflection faces 23 and 24 each having a sawtooth cross section shape are formed on the lower face of the smoke detecting unit body 5 and on the inner face of the smoke detecting unit cover 11, respectively. If infrared rays from the smoke-detecting infrared LED 21 are incident on the antireflection faces 23 and 24, the antireflection faces 23 and 24 prevent the directly reflected light from being incident on the light receiving device 20. A space surrounded by the antireflection faces 23 and 24, the plurality of labyrinth members 13, the holders 16 and 17, etc. constitutes a smoke detecting chamber 25A. A smoke detecting space 25 is formed at the center of the smoke detecting chamber 25A.

A light receiving portion cover 26 which functions as the light receiving portion covering member is detachably attached to the holder 16 which accommodates the light receiving device 20. A shield cap 27 is attached to the light receiving portion cover 26.

Figure 4:
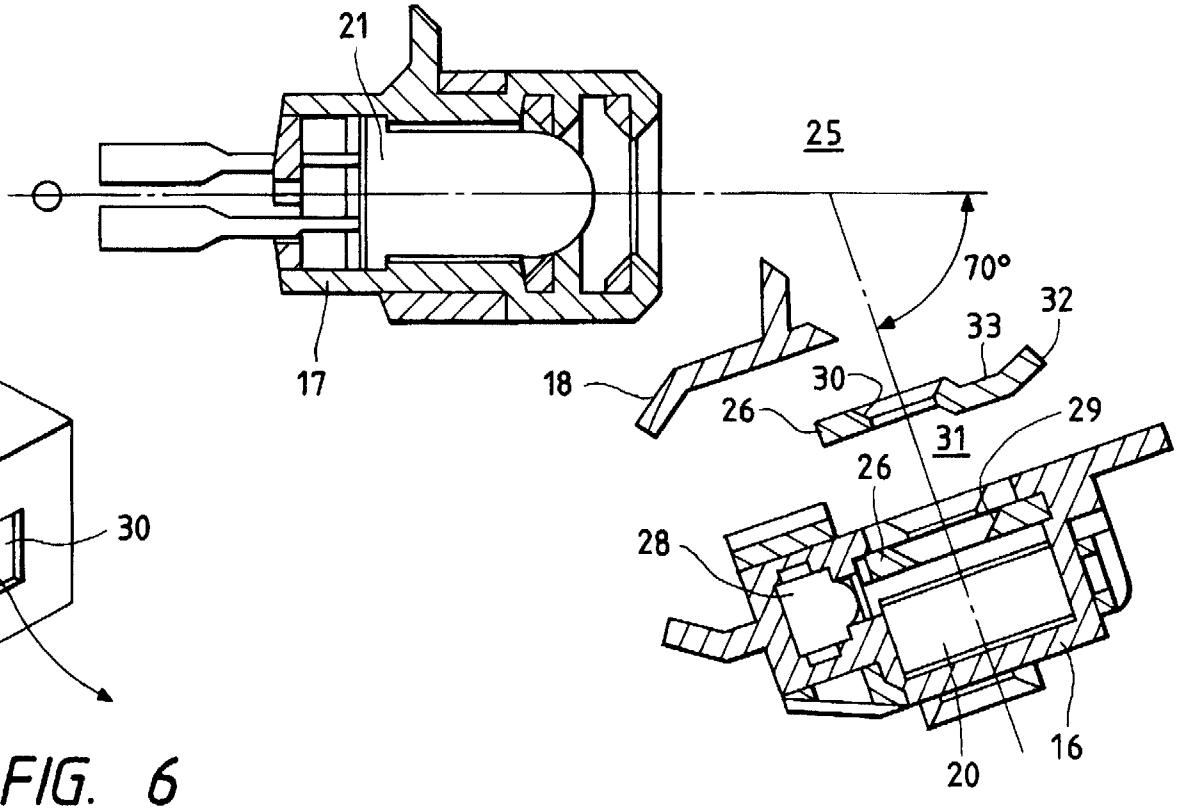
FIG. 4 is a cross section view of a holder and a light receiving portion cover.

As shown in FIG. 4, the holders 17 and 16 which respectively accommodate the smoke-detecting infrared LED 21 and the light receiving device 20 are formed integrally with the smoke detecting unit body 5 in such a manner that the optical axes of the smoke-detecting infrared LED 21 and the light receiving device 20 cross each other at an angle of, for example, 70° at the center of the smoke detecting space 25. The holder 16 accommodates a test infrared LED 28 and the light receiving device 20 in such a manner that a perpendicular plane through which the optical axis of the test infrared LED 28 passes and a perpendicular plane through which the optical axis of the light receiving device 20 passes cross each other at right angles, but the optical axes of the devices do not cross each other.

The light receiving portion cover 26 is detachably attached to the holder 16. The light receiving portion cover 26 includes a first diaphragm portion 29 which is disposed just ahead of the light receiving device 20, and a second diaphragm portion 30 which is disposed ahead of the first diaphragm portion 29 so as to be separated by a distance therefrom. A smoke introducing portion 31 for introducing smoke from the outside to the smoke detecting space 25 through the second diaphragm portion 30 is provided between the first diaphragm portion 29 and the second diaphragm portion 30. A labyrinth receiving portion 33 for receiving the labyrinth member 13 is formed in a plate member 32 in which the second diaphragm portion 30 is disposed.

An external appearance of the light receiving portion cover 26 is shown in FIG. 1. In FIG. 1, a square opening which functions as the first diaphragm portion 29 is formed in a plate member 34 of the light receiving portion cover 26. A square opening which functions as the second diaphragm portion 30 is formed in the plate member 32 which is located in parallel to the plate member 34. These first and second diaphragm portions 29 and 30 define the visual field of the light receiving device 20 in the upward, downward, rightward, and leftward directions. That is, since the first and second diaphragm portions 29 and 30 are provided, the ceiling face (the antireflection face 23) and the floor face (the antireflection face 24) of the smoke detecting chamber 25A, and the inner walls of the peripheral wall 12 on the right and left sides are out of the visual field of the light receiving portion 20. Accordingly, reflected light from the ceiling face and the floor face of the smoke detecting chamber 25A and the right and left inner walls of the peripheral wall 12 can be prevented from entering the light receiving device 20.

A space between the plate member 32 and the plate member 34, i.e., a space between the first diaphragm portion 29 and the second diaphragm portion 30 is opened so as to form the smoke introducing portion 31 for introducing smoke. As indicated by the arrow, external smoke which flows between the labyrinth members 13 is introduced into the smoke introducing portion 31, passes through the second diaphragm portion 30, and then enters the smoke detecting space 25. That is, immediately after the entering smoke passes through the smoke introducing portion 31 and the second diaphragm portion 30, it enters the smoke detecting space 25. Accordingly, the delay of the smoke detection can be prevented from occurring, and the smoke can rapidly be detected.

Figure 6:
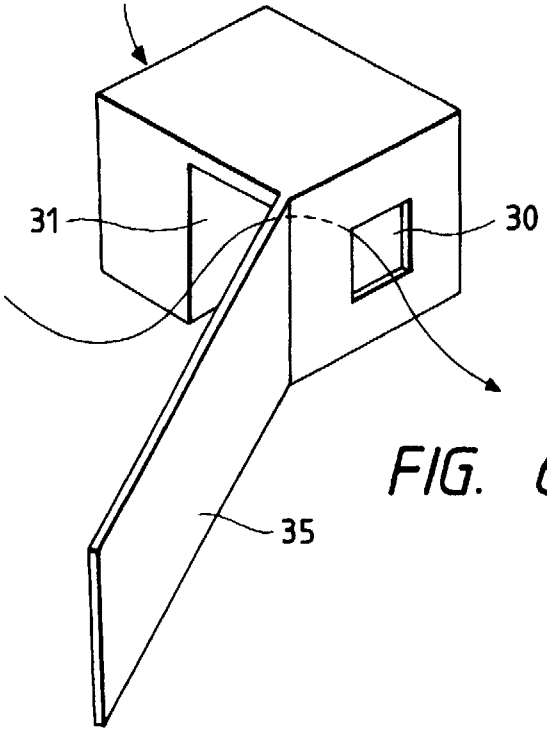
FIG. 6 is a view showing another embodiment of the light receiving portion cover.

The labyrinth receiving portion 33 for receiving the one labyrinth member 13 is integrally formed with the plate member 32. Alternatively, as shown in FIG. 6, the plate member 32 may be extended and the labyrinth member 13 is integrally formed, so as to form a long plate member 35. Alternatively, the plate member 32 may be integrally formed with the light receiving portion cover 26 as shown in the drawings, and the plate member 32 is provided on the smoke detecting unit cover 11 to be independently formed with respect to the light receiving portion cover 26.

Figure 5:
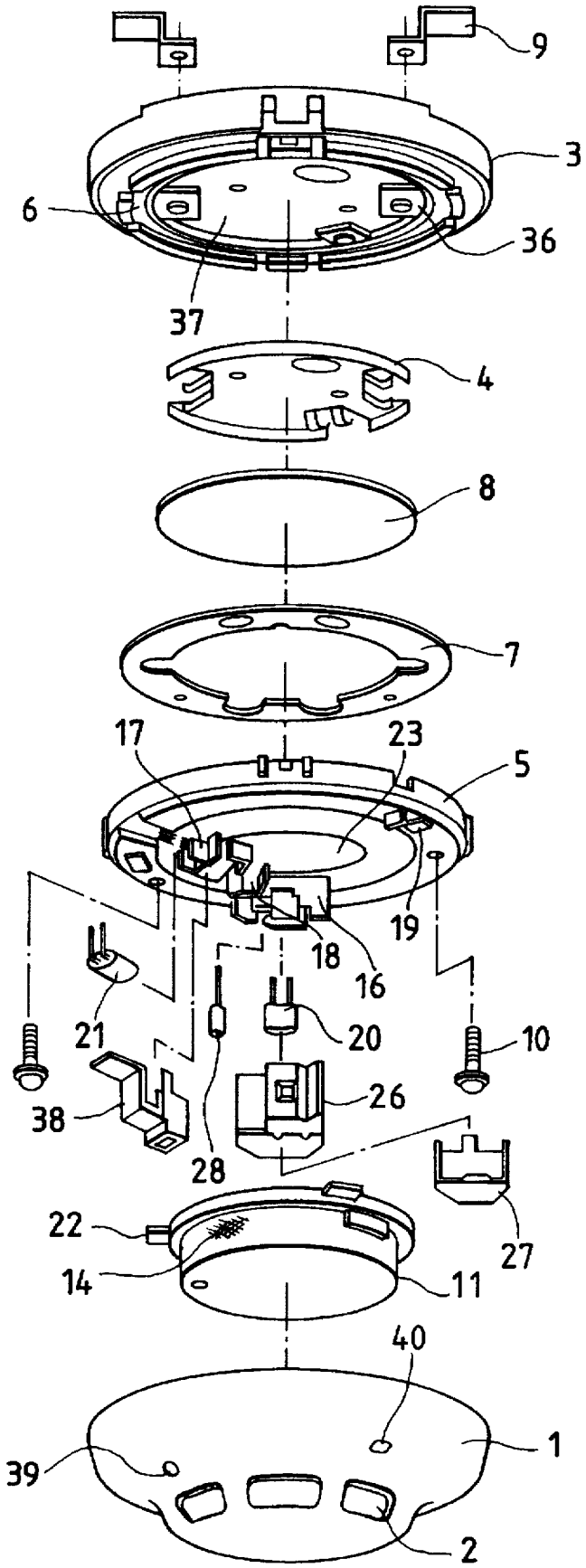
FIG. 5 is a view illustrating the assembly of the light scattering smoke sensor.

FIG. 5 is a view illustrating the assembly of the light scattering smoke sensor.

Referring to FIG. 5, the terminal board 3 includes an attachment portion on the upper face thereof so as to attach fitting metal pieces 9 for mechanical and electrical connection with a base which is separately attached to the ceiling face. The lower face of the terminal board 3 includes a fitting groove 6 into which the smoke detecting unit body 5 is to be fitted, an attachment portion 36 to which the smoke detecting unit body 5 and the like are attached, an accommodating portion 37 which accommodates the printed circuit board 8 on which electronic circuits are mounted, etc.

The shield case 4 is inserted along the inner circumferential face of the accommodating portion 37 of the terminal board 3, and the printed circuit board 8 is accommodated therein. The smoke detecting unit body 5 is fitted into the fitting groove 6 of the terminal board 3. The smoke detecting unit body 5, the packing 7, the printed circuit board 8, and the engagement metal pieces 9 are fixed to the terminal board 3 by means of the screws 10.

The holders 16 and 17, and the light shielding member 18 vertically protrude from the smoke detecting unit body 5. The antireflection face 23 is formed on the lower face of the smoke detecting unit body 5, and the attachment portion 19 is formed on the outer periphery in the circumferential direction. The holder 17 accommodates the smoke-detecting infrared LED 21, and a light emitting portion cover 38 for covering the smoke-detecting infrared LED 21 is attached to the holder 17. The holder 16 accommodates the light receiving device 20 and the test infrared LED 28, and the light receiving portion cover 26 for defining the visual field of the light receiving device 20 and for introducing smoke is attached to the holder 16. The light receiving portion cover 26 is detachably attached to the holder 16 so that one of the labyrinth members 13 butts against the labyrinth receiving portion 33 of the light receiving portion cover 26. The shield cap 27 is attached to the light receiving portion cover 26.

The projection 22 of the smoke detecting unit cover 11 is inserted into the attachment portion 19 of the smoke detecting unit body 5, so that the smoke detecting unit cover 11 is detachably attached to the smoke detecting unit body 5. The insect net 14 is fixed to the outer periphery of the smoke detecting unit cover 11. Finally, the outer cover 1 having openings 2 is attached to the terminal board 3 so as to cover the smoke detecting unit body 5 and the smoke detecting unit cover 11. In the outer cover 1, a drain hole 39 and an alarm indication window 40 are formed.

Next, the operation will be described.

In the monitoring condition, the smoke-detecting infrared LED 21 is intermittently driven by the control of the electronic circuits on the printed circuit board 8. Thus, infrared rays are intermittently emitted from the smoke-detecting infrared LED 21 to the smoke detecting space 25. If there is no smoke in the smoke detecting space 25, the emitted infrared rays are not directly incident on the light receiving device 20. Accordingly, the output of the sensor is at a level corresponding to the state which indicates a zero smoke density.

If smoke is produced due to a fire or the like outside of the sensor, the smoke passes through the openings 2 of the outer cover 1, the insect net 14, the smoke inlet 15 of the smoke detecting unit cover 11, and the gaps between the labyrinth members 13, and then enters the smoke detecting space 25.

Infrared rays from the smoke-detecting infrared LED 21 are intermittently emitted into the smoke detecting space 25. When the infrared rays impinge on the smoke which enters the smoke detecting space 25, light is scattered by smoke particles. The scattered light is captured by the first and second diaphragm portions 29 and 30 of the light receiving portion cover 26, and then incident on the light receiving face of the light receiving device 20.

In this case, since the light receiving portion cover 26 comprises the smoke introducing portion 31 disposed between the first diaphragm portion 29 and the second diaphragm portion 30, the smoke which has passed through the insect net 14, the smoke inlet 15, and the gaps between the labyrinth members 13 is introduced into the smoke introducing portion 31 of the light receiving portion cover 26, as indicated by arrow A in FIG. 2. Then, the smoke flows into the smoke detecting space 25 through the second diaphragm portion 30. The smoke reaches the smoke detecting space 25 immediately after it passes through the second diaphragm portion 30. Accordingly, the smoke detection is not delayed, and the smoke detection can rapidly be performed. As a result, the delay of the fire alarm can be prevented in advance from occurring.

The light receiving portion cover 26 includes the first and second diaphragm portions 29 and 30, so as to define the visual field of the light receiving device 20 in the upward, downward, rightward, and leftward directions. Therefore, the reflected light from the ceiling face and the floor face of the smoke detecting chamber 25A, the right and left inner faces of the peripheral wall 12, and the like can be prevented from being received by the light receiving device 20. Accordingly, the S/N ratio can be improved, and it is possible to reduce the influence due to disturbance such as dust, condensation, and the like.

As described above, the sensor of the invention is provided with a light receiving portion covering member which comprises: a first diaphragm portion disposed just ahead of the light receiving device; a second diaphragm portion disposed ahead of the first diaphragm portion and separated by a distance therefrom; and a smoke introducing portion which is disposed between the first diaphragm portion and the second diaphragm portion and introduces smoke from a gap between labyrinth members. According to this configuration, smoke flowing between the labyrinth members is introduced into the smoke introducing portion, and then enters the smoke detecting space after passing through the second diaphragm portion. Even when the labyrinth members are formed so as to have a large size, therefore, the delay of the smoke detection can be prevented from occurring, and the smoke detection can rapidly be performed. As a result, the delay of the fire alarm can be prevented in advance from occurring.

A light receiving cover having the second diaphragm member is disposed ahead of the first diaphragm portion so as to be separated by a distance therefrom. With this construction, any distortion in the shape of the sensor does not largely affect the light-receiving visual field, and hence the characteristics are not varied among individual sensors.

Since the first diaphragm portion and the second diaphragm portion are disposed, the visual field of the light receiving device can be defined in the upward, downward, rightward, and leftward directions. Accordingly, reflected light from the ceiling face, the floor face, and the right and left peripheral walls of the smoke detecting space can be prevented from entering the light receiving device. As a result, the S/N ratio can be improved, and it is possible to reduce the influence by disturbance such as dust, condensation, and the like.

What is claimed is:

1. A light scattering smoke sensor comprising:

a housing defining a smoke detecting space therein, said housing having an opening for introducing smoke into said smoke detecting space;

a plurality of labyrinth members located within said housing and substantially surrounding said smoke detecting space;

light emitting means for emitting light to said smoke detecting space;

light receiving means for receiving light scattered by smoke introduced into said smoke detecting space;

first diaphragm means, which is disposed in front of said light receiving means, for defining a visual field of said light receiving means;

second diaphragm means, which is disposed in front of said first diaphragm means, for defining a visual field of said light receiving means; and a cover member for covering said receiving means, in which said first diaphragm means is provided wherein said first and second diaphragm means defining a smoke introducing section therebetween through which said smoke passes as said smoke flows from said opening to said smoke detecting space.

2. A light scattering smoke sensor according to claim 1, wherein said second diaphragm means is provided in a plate member, said plate member having a labyrinth receiving portion for receiving at least one of said plurality of labyrinth members.

3. A light scattering smoke sensor according to claim 2, wherein said plate member is integrally formed with said cover member.

4. A light scattering smoke sensor according to claim 1, wherein said second diaphragm means is provided in a plate member, said plate member being integrally formed with at least one of said plurality of labyrinth members.

5. A light scattering smoke sensor according to claim 4, wherein said plate member is integrally formed with said cover member.

6. A light scattering smoke sensor according to claim 1, wherein said second diaphragm means is provided in a plate member, said plate member being integrally formed with said cover member.

7. A light scattering smoke sensor according to claim 1, further comprising a holder for holding said light receiving means, wherein said cover member is detachably inserted into said holder.

8. A light scattering smoke sensor according to claim 1, further comprising an antireflection means, which is provided on a ceiling face and a floor face of said smoke detecting space, for preventing a reflection of light.

* * * * *